United States Patent [19]

Okamoto et al.

[11] Patent Number: 5,055,878

[45] Date of Patent: Oct. 8, 1991

[54] IMAGE FORMING APPARATUS

[75] Inventors: Keiji Okamoto; Takeshi Komurasaki, both of Yokohama, Japan

[73] Assignee: Ricoh Company, Ltd., Tokyo, Japan

[21] Appl. No.: 470,213

[22] Filed: Jan. 25, 1990

[30] Foreign Application Priority Data

Jan. 31, 1989 [JP] Japan ..... 1-19582

[51] Int. Cl.[5] ..... G03G 15/02

[52] U.S. Cl. ..... 355/219; 250/324; 355/221

[58] Field of Search ..... 250/324, 325, 326; 355/219, 221, 222, 223, 226; 361/225, 230

[56] References Cited

U.S. PATENT DOCUMENTS 3,922,548 11/1975 Honda ..... 250/324

4,322,516 3/1982 Kohyama ..... 250/324 X 4,566,777 1/1986 Honda et al. ..... 355/219 X 4,803,512 2/1989 Ogura et al. ..... 355/219

*Primary Examiner*—A. T. Grimley

*Assistant Examiner*—Christopher Horgan

*Attorney, Agent, or Firm*—Oblon, Spivak, McClelland, Maier & Neustadt

[57] ABSTRACT

The image forming apparatus is arranged accurately to keep a constant distance between the surface of the photosensitive element and a charging device. The charging device is composed as a part of an integrated unit with another device which is located around the surface of the photosensitive element. When the unit is mounted on the main body of the apparatus, the charging device is in contact with a positioning means which is provided on the image forming apparatus.

3 Claims, 2 Drawing Sheets

IMAGE FORMING APPARATUS

BACKGROUND OF THE INVENTION

The present invention relates to an electrophotographic copier, laser printer, facsimile apparatus or similar image recorder and, more particularly, to an image forming apparatus having an charging device provided at a constant distance from the surface of a photosensitive element. In an image forming apparatus which employs an eletrostatic photographic process, photosensitive element has its surface uniformly charged by a charging device, and electrostatic latent image is formed on the surface of the photosensitive element by an optical beam.

To charge the surface of the photosensitive element uniformly, the image forming apparatus must be arranged accurately to keep a constant distance between the surface of the photosensitive element and the charging device.

Particularly, in the case that the charging device is composed as a part of an integrated unit with another device, for example, a cleaning unit which is located around the surface of the photosensitive element, it is difficult to keep an accurate position of charging device against the surface of the photosensitive element.

According to the prior art, as the controlled method to have a constant distance between the surface of the photosensitive element and the charging device, there are some known methods; one method is that the charging device is fixed to the predetermined position after mounting on a main body frame, and the distance of the gap between the surface of the photosensitive element and the charging wire of the charging device is adjusted. Still another method is that a roller which is mounted on the charging device is in contact with the surface of the photosensitive element so that the wire of the charging device can be positioned at a constant distance with respect to the surface of the photosensitive element.

This typical known method is described in U.S. Pat. No. 4,627,701.

However, such method may incur many problems; it would take a long time to assemble the charging device and adjust the gap between the surface of the photosensitive element and the charging device, it would result in higher cost, the surface of the photosensitive element would be scratched by a service person during the above mentioned adjusting time.

SUMMARY OF THE INVENTION

It is therefore an object of the present invention to provide an image forming apparatus which is capable of maintaining a constant distance between the surface of a photosensitive element and a charging device with a simple and inexpensive structure to present the surface of the photosensitive element from scratching.

According to this invention, the image forming apparatus is provided with a support means which supports the charging device which is movable in a vertical direction perpendicular to the surface of the phtosensitive element in order to change the distance of the gap between the surface of the photosensitive element and the charging device, and a positioning means which is in contact with the charging device and positions the charging device in order to maintain a constant distance between the surface of the photosensitive element and the charging device when the support means is mounted on a main body of the image forming apparatus.

Therefore, even if the support means having the charging device cannot be mounted on the main body accurately, the charging device maintains a constant distance to the surface of the photosensitive element without being in contact with the surface of the photosensitive element by positioning the positioning means on the main body accurately to locate the charging device, when mounted on the main body, to the contact with the positioning means.

DESCRIPTION OF THE PREFERRED EMBODIMENTS

Figure 4:
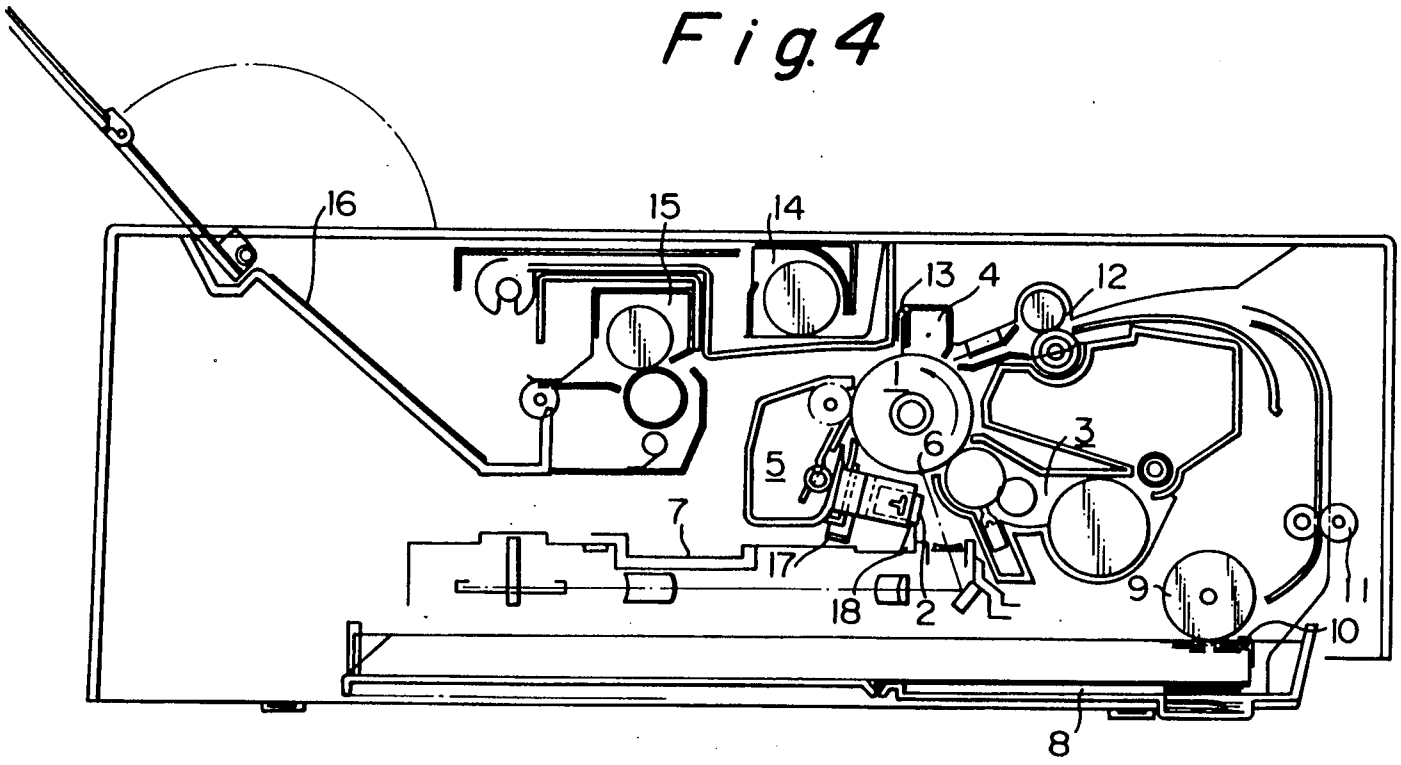
FIG. 4 is a side sectional view of a laser beam printer embodying the present invention.

FIG. 4 shows a laser beam printer which is implemented by an embodiment of the present invention.

In the FIG. 4, a charging device 2, a developing unit 3, a transfer charger 4 and a cleaning unit 5 as an example of a support means are located around a surface of the photosensitive drum 1 in a direction of the rotation of the photosensitive drum 1 as shown by an arrow.

A laser optics unit 7 emits a laser beam which form latent image on the surface of the photosensitive drum 1 at a position 6 between the charging device 2 and the developing unit 3.

The charging device 2 and the position 6 are defined below the photosensitive drum 1.

The laser optics unit 7 is located below the photosensitive drum 1, the developing unit 3 and the cleaning unit 5.

On the other hand, transfer charger 4 is located above the photosensitive drum 1.

A paper cassette 8 can be placed below the laser optics unit 7.

Paper sheets are fed one by one using a paper feed roller 9 and a corner separater 10 toward a pair of transport rollers 11 and the transport rollers 11 transport the paper sheet above the developing unit 3 and then a pair of a register rollers 12 transport the paper sheet to the transfer portion so as to be coincident with a leading edge of the paper sheet with the leading edge of the latent image on the photosensitive drum 1.

A discharging brush 13 is provided on a paper sheet path just after transfer position for separating the paper sheet from the surface of the photosensitive drum 1.

The paper sheet carrying the toner image thereon is further transported to a fixing device 15 while being sucked by a sucking device 14.

The paper sheet coming out of the fixing device 15 is discharged on a paper tray 16.

The photosensitive drum 1 has its surface uniformly charged by the charging device 2 and then has formed thereon the latent image by a laser beam emitted from the laser optics unit 7.

The latent image is developed by the toner fed from the developing unit 3.

The toner image is transferred by the transfer charger 4 to the paper sheet which is drived by a pair of the register rollers 12.

The paper sheet which toner image is transfered is separated from the surface of the photosensitive drum 1 by use of the discharging brush 13.

After that, the paper sheet is further transported to the fixing device 15 while being sucked by a sucking device 14, and the paper sheet coming out of the fixing device 15 is discharged to the paper tray 16.

On the other hand, after the image is transferred, the toner particles remaining on the photosensitive drum 1 are removed by a cleaning unit 5, and a remaining electric charge on the photosensitive drum 1 is discharged by a discharging device 17 for the next image forming process.

In the printer of this embodiment, charging device 2 is supported on the cleaning unit 5 and the cleaning unit 5 is detachably mounted on a frame of the main body at the position as shown in FIG. 4.

In this case, the distance of the gap between the surface of the photosensitive drum 1 and the charging device 2 must be controlled accurately for preventing the appearance of an "inclined charge" which causes a change of an electric charge quantity in the axis direction of the photosensitive drum 1 and an "uneven charge".

Figure 1:
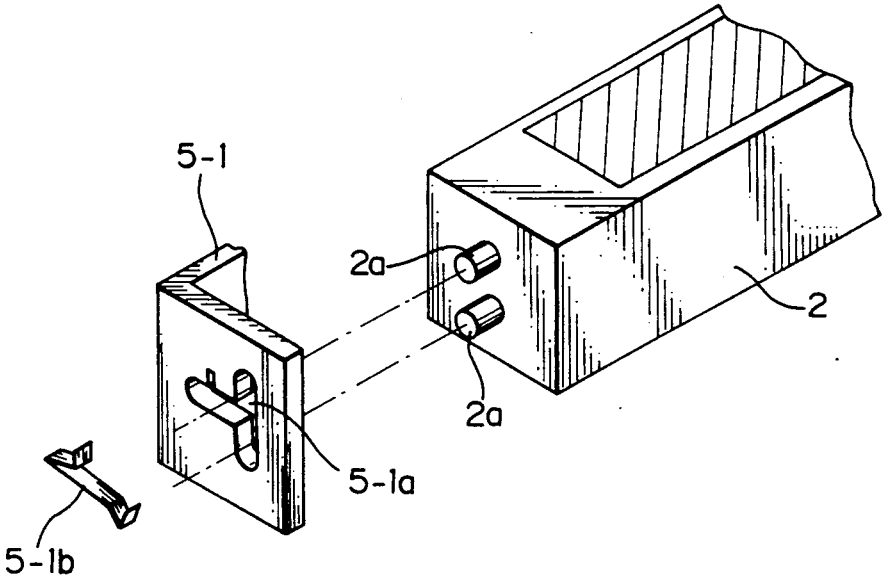
FIG. 1 is a perspective view of the charging device is supported with the support member of the cleaning unit.

FIG. 1 shows an example of the charging device which is supported movably on a charging device support member 5-1 of the cleaning unit 5.

An opening 5-1*a* like the form of the letter T is formed on the support member 5-1, and projections 2*a* are provided on the one side wall of the charging device 2.

These projections 2*a* are inserted into a vertical part of the opening part 5-1*a* which forms a slot extending toward the photosensitive drum.

The vertical part of the opening 5-1*a* is so formed as to control the gap between the surface of the photosensitive drum 1 and the charging device 2 when the cleaning unit 5 is mounted on the main body, and the projections 2*a* can slide in said direction.

The spring 5-1*b* which presses the projections 2*a* away from the surface of the photosensitive drum 1 is provided with the opening 5-1*a*.

As as result, the charging device 2 is forced to be apart from the photosensitive drum 1 by the spring 5-1*b*.

Figure 2:
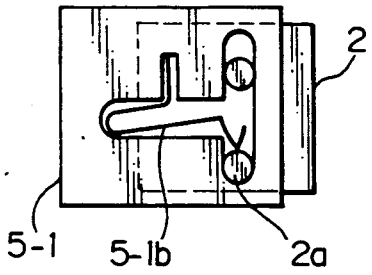
FIG. 2 is a side view of the charging device as shown in FIG. 1.

FIG. 2 shows that the charging device 2 is supported with the support member 5-1 of the cleaning unit 5.

One of the projections 2*a* is pressed against the bottom end of the opening 5-1*a* by the spring 5-1*b* as shown in FIG. 2.

Figure 3:
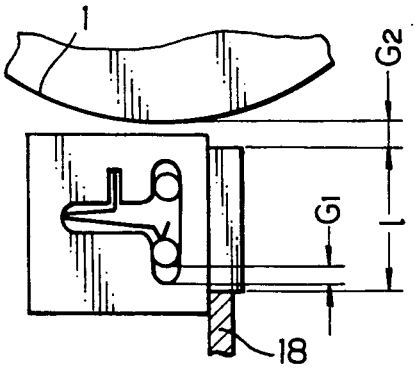
FIG. 3 is a side view of the support means which is mounted on the main body of a laser beam printer.

FIG. 3 shows the condition of the charging device 2 after the cleaning unit 5 is mounted on the main body of the printer.

A projected member 18 as an example of a positioning means is fixed to the main body of the printer accurately, whose position is determined by calculating the distance of the gap G2 between the surface of the photosensitive drum 1 and the charging device 2 and a size 1 of the charging device 2.

As shown in FIG. 3, when the cleaning unit 5 is mounted on the main body of the printer, the charging device 2 which is supported on the cleaning unit 5 is pressed by the projected member 18 towards to the photosensitive drum 1, and is moved by the distance G1 upwardly against the force of the spring 5-1*b*.

Therefore the size of the gap G2 can be secured.

In this case, the charging device 2 is initially separated from the surface of the photosensitive drum 1 by an excess distance G1 and the charging device 2 is prevented from damaging the surface of the photosensitive drum 1 by contacting with the surface when the charging device 2 is mounted on the main body.

In the above mentioned embodiment of this invention, the support member which supports the charging device 2 is movably mounted on the cleaning unit 5.

Said support member which supports the charging device 2 may be replaced by another member of the image forming device.

The present invention also is applicable to a unit case having integrated equipment, which case is equipped with the charging device 2.

What is claimed is:

1. An image forming apparatus comprising:

a main body;

a photosensitive element mounted to said main body;

a charging means for forming an electrostatic latent image on the photosensitive element;

a support means removably mountable in said main body and movably supporting the charging means by means permitting the size of a gap between the surface of the photosensitive element and the charging means to vary; and a positioning means which contacts the charging means and positions the charging means at a constant distance from the surface of the photosensitive element when the support means is mounted on said image forming apparatus, wherein said means permitting the size of the gap to vary comprises a slot in said suport means and a projection of said charging means which slidably fits in said slot, said slot extending toward said photosensitive drum.

2. The image forming apparatus according to claim 1, wherein said support means is a cleaning unit.

3. The image forming apparatus of claim 1 wherein said positioning means comprises a projected member.

* * * * *